US007481402B2

(12) United States Patent
Woodward

(10) Patent No.: US 7,481,402 B2
(45) Date of Patent: Jan. 27, 2009

(54) ELECTROSTATIC DISSIPATIVE ERGONOMIC FOREARM SUPPORT

(76) Inventor: Candice Woodward, 1651 E. Fourth St., Suite 234, Santa Ana, CA (US) 92701

( * ) Notice: Subject to any disclaimer, the term of this patent is extended or adjusted under 35 U.S.C. 154(b) by 1 day.

(21) Appl. No.: 11/413,861

(22) Filed: Apr. 28, 2006

(65) Prior Publication Data

US 2007/0252049 A1 Nov. 1, 2007

(51) Int. Cl.
*B43L 15/00* (2006.01)

(52) U.S. Cl. ..... 248/118.1

(58) Field of Classification Search ..... 248/118, 248/118.1, 118.3, 118.5
See application file for complete search history.

(56) References Cited

U.S. PATENT DOCUMENTS 5,163,646 A * 11/1992 Engelhardt ..... 248/118
5,163,850 A * 11/1992 Cronin ..... 439/507
5,195,705 A * 3/1993 Kline et al. ..... 248/118.3
5,342,005 A * 8/1994 Szmanda et al. ..... 248/118
5,451,020 A * 9/1995 Smith et al. ..... 248/118
6,219,867 B1 * 4/2001 Yates ..... 5/655.5
7,157,633 B1 * 1/2007 Kopesec ..... 84/293
2001/0009263 A1 * 7/2001 Chou ..... 248/118
2005/0054905 A1 * 3/2005 Corl et al. ..... 600/309
2005/0092871 A1 * 5/2005 Wolf et al. ..... 248/118.1
2007/0045486 A1 * 3/2007 Stewart et al. ..... 248/118.1

* cited by examiner

*Primary Examiner*—Ramon O Ramirez
(74) *Attorney, Agent, or Firm*—Russo & Duckworth, LLP

(57) ABSTRACT

A forearm support is provided for use within electrostatic sensitive areas. The forearm support has a bottom and one or more sides. Preferably, the top, bottom and sides are made of a flexible electrically conductive fabric which forms an interior filled with a resilient foam. As measured from the support's top surface to its bottom surface, the support has an electrical resistance value of less than $1\times10^9$ ohms.

14 Claims, 3 Drawing Sheets

ELECTROSTATIC DISSIPATIVE ERGONOMIC FOREARM SUPPORT

BACKGROUND OF THE INVENTION

Operators of scientific equipment are known to experience discomfort and fatigue of their fingers, wrists and/or arms after extended periods of operating various devices. For example, operators of microscopes must constantly manipulate various controls and knobs of the microscope to bring various specimens into view. Hours of such manipulation may cause one's arms, hands and/or fingers to become sore, fatigued and may even lead to painful musculo-skeletal disorders like tendonitis and carpel tunnel syndrome. In addition, persons performing benchwork, such as working on printed circuit boards, whether for inspection, manufacturing or repair, are often positioned in unnatural positions and must repeatedly manipulate various devices and tools during their job. In order to support their body, workers often rest their elbows, forearms and wrists on hard work surfaces. Persons also lean against desks to prevent painful muscular skeletal stain associated with working in awkward positions which, over time, can cause alternative physical maladies.

Various devices have been developed in at attempt to reduce the strain upon the body for those working on scientific equipment. For example, a product sold under the trademark Wedge-Ease® has been sold to reduce the strain for those persons who utilize microscopes for extended periods of time. The Wedge-Ease® consists of a cushioning pad 1-3 inches thick, 10 inches long and 3-5 inches wide. The Wedge-Ease® includes a vinyl cover encasing a foam interior. Persons utilizing the Wedge-Ease® place their forearm, wrist or elbow upon the pad which has been found to relieve fatigue and discomfort to one's upper extremities, neck and back. The device also eliminates resting one's elbows and forearms on a hard work surface. Unfortunately, devices such as the Wedge-Ease® are not suitable for use in proximity to electrostatic sensitive devices as the pad does not properly dissipate static charge and therefore can cause damage to sensitive devices.

Static electricity is commonly defined as an electrical charge resulting from the imbalance of electrons on the surface of a material. Most people are quite familiar with the every day effects of static electricity, as it is the shock that one experiences when touching a door knob or other device having a different electrical potential. The scientific name for the electrical shock is electrostatic discharge ("ESD").

In every day situations, ESD can be an annoyance, but it is rarely a problem. However, the problems resulting from ESD are magnified within industrial settings, such as where persons are utilizing ESD sensitive electronics. In addition, static discharge can cause the unintentional ignition of flammable materials and the attraction of contaminants such as charged dust particles within a clean room environment. Even centuries ago, people were concerned with ESD ramifications as it was found to ignite black powder ammunition.

Today, the electronics industry is most concerned with ESD damage. It can destroy or degrade semiconductor devices by changing operational characteristics. In clean rooms it has been found to cause charged particles to adhere tightly to the surface of a silicon wafer, resulting in distinct problems with circuit board production and efficiency.

ESD control programs are typically implemented to dissipate ESD. These techniques include coating work surfaces, including floors and bench tops, with ESD resistive coatings. An additional ESD device is known as a grounding strap. A grounding strap is physically connected between an electrostatically charged source, such as a human being or other electronic device, to an electrical ground. In practice, any electrical potential between a human body and ground is reduced as charged electrons pass through the body and grounding strap. Unfortunately, the physical straps are cumbersome to attach and wear. In addition, due to their annoyance, persons will intentionally avoid using their ground straps which can cause damage to electrically sensitive devices.

The level of ESD protection provided by an object is directly related to the time needed to discharge its electrical potential. For example, it is known that the electrical resistance between two points can be correlated to the ESD potential, and thus electrical resistance values between two points are indicative of the effectiveness of the objects for resisting ESD. While in reality, the time it takes for an object to discharge is related to factors in addition to resistance, such as capacitants, contact resistance and discharge paths, it has been found that the resistance measurements provides an effective predictor of the potential for ESD. Accordingly, objects within electrostatic sensitive areas, such as flooring materials, packaging materials, and bench tops, are measured point-to-point to determine their ground resistance.

Various standards have been developed for measuring the resistance of work surfaces and other objects as a predictor of ESD potential. For example, ANSI/ESD STM 97.1-1999 is an accepted standard for testing flooring materials and footwear. In addition, ANSI/ESD STM S20.20-1999 provides a standard for determining whether objects as acceptable for use within an electrostatic discharge sensitive area. Both ANSI/ESD STM 97.1-1999 and ANSI/ESD STM S20.20-1999 are incorporated herein by reference in their entirety.

Perhaps because of the complexity and problems posed by ESD, upper extremity supports do not exist for operators working in ESD sensitive areas. Accordingly, persons using microscopes or working on electronics within an ESD sensitive area cannot use existing upper extremity supports as they unduly collect electrical charge and pose a significant ESD hazard.

Therefore, there is a significant need for a device which will reduce the discomfort and musculo-skeletal disorders that are suffered by those working in ESD sensitive areas.

It would be advantageous to provide a device which reduced worker fatigue and discomfort also complied with various ESD standards.

Furthermore, it would be advantageous if the device were inexpensive to manufacture, easy to use, and affordable to the end user.

SUMMARY OF THE INVENTION

The present invention addresses the aforementioned disadvantages by providing an ergonomic forearm support suitable for use in electrostatic sensitive areas. The ergonomic forearm support includes a top, a bottom and one or more sides. The top and bottom are preferably planar, and the top and bottom may or may not be parallel. Preferably, the forearm support includes four sides to form a rectangular or truncated form. Alternatively, the forearm support may be formed to have more or less sides. For example, the forearm support can have three sides or even a single side where the forearm support is round or oval.

The top, bottom and sides are made of a flexible and electrically conductive material so that the support is capable of conducting electricity from the top of the support to its bottom. In addition, it is preferred that the bottom of the support be made of, or include, an electrically conductive material so that the bottom can conduct electrons to a ground path.

Various materials are capable of conducting electricity. However, many such materials such as metals, are not sufficiently soft or flexible to provide comfort to support one's arm. Meanwhile, various static dissipative fabrics are available which provide sufficient electrical conduction and flexibility to function as a material for supporting ones arm. For example, a material sold under the trademark DURA-STAT® by Duracoat Corporation of Ohio has been found to be a suitable material. The DURA-STAT® material is a multi-layered construction in which the top and bottom layers are made of a vinyl blend to provide semiconductive, non-tacky, color stable, durable and dirt resistant properties. In addition, the DURA-STAT® vinyl material includes an interior conductive layer interwoven between outer layers.

The bottom of the forearm support may also be made of a static dissipative material such as DURA-STAT®. However, it is preferred that the bottom also include a non-slip surface so that movement of the support is inhibited when placed upon a flat surface, such as upon a laboratory desk. Again, various materials such as nylon, polyvinylchloride or even rubber are suitable for functioning as the forearm support's non-skid bottom. However, where the bottom surface is not highly conductive, it is preferred that the bottom include a highly conductive strip of material electrically connected to the support's sides and top. For example, in a preferred embodiment, the forearm support includes a conductive ribbon extending longitudinally the length of support's bottom. Preferably, the conductive ribbon is made of polyester and carbon nylon fibers interwoven to create a ribbon having a width of 9 1/16 inch and a thickness of 0.008 inch. A suitable ribbon has a fiber content of 89% polyester and 11% carbon nylon so as to provide a resistivity of 75,000 ohms/inch or less. Suitable conductive ribbons can be obtained by Pantion Industries, Inc. of Miami, Fla.

Preferably the forearm support of the present invention includes a highly compressible and resilient material within the support's interior to provide added comfort for one's forearm upon the support. Because the support's tops, sides and at least a portion of its bottom are electrically conductive, the interior material need not be electrically conductive. Thus, various materials such as flexible urethane foam are acceptable. Alternatively, the interior may contain conductive fibers or even flexible wiring to provide additional electrical conduction from the support's top surface to its bottom surface.

As would be understood by one skilled in the art, the support may be constructed in an infinite number of shapes. However, it is preferred that the support be small enough to be easily manually maneuvered upon a work surface. Furthermore, it is preferred that the support is sufficiently large to comfortably support one's forearm, but sufficiently small so as to not take up excessive space upon a cluttered desk. In a preferred embodiment, the forearm support has a height of between one half and four inches as measured from its top to bottom, is two to eight inches wide, and is four to sixteen inches in length. Even more preferably, the forearm support has a height of one to three inches, a width of three to five inches, and a length of eight to twelve inches. These dimensions are sufficiently large so as to support ones forearm, but small enough that it can be easily moved and used within a laboratory setting. In addition, the thickness is sufficiently small so that the conductive material of the top and sides enables the resistance from top to bottom to be less than $1\times10^9$ ohms. So as to comply with ANSI/ESD S20.20-1999.

It is thus an object of the present invention to provide a support for use by persons to support their forearm while working on electrostatic sensitive objects.

It is still an object of the present invention to provide a support which has a resistance value, as measured from top to bottom, of less than $1\times10^9$ ohms.

It is a further object of the present invention to provide a support which is lightweight and has a soft flexible resilient property so as to provide comfort in supporting ones forearm when working within a laboratory setting.

DETAILED DESCRIPTION OF THE INVENTION

DETAILED DESCRIPTION OF THE INVENTION

Figure 1:
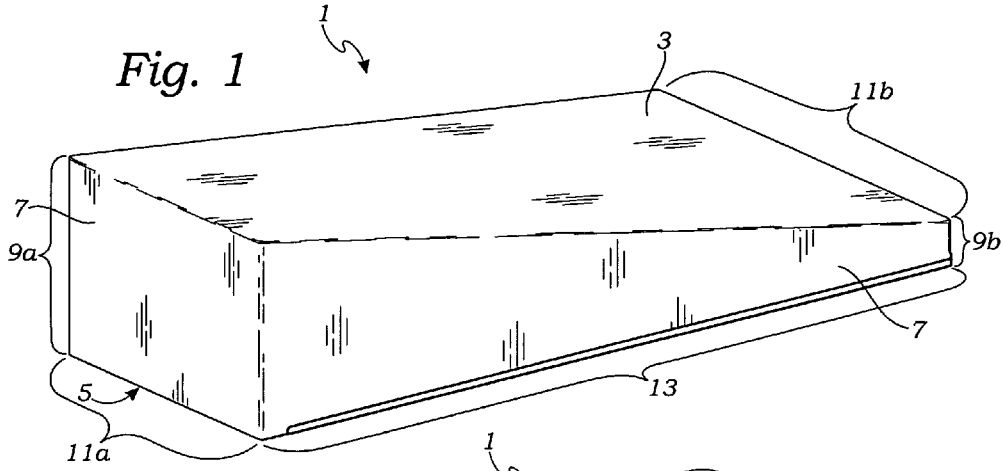
FIG. 1 is a perspective view illustrating a first embodiment of the forearm support of the present invention.

While the present invention is susceptible of embodiment in various forms, as shown in the drawings, hereinafter will be described the presently preferred embodiment of the invention with the understanding that the present disclosure needs to be considered as an exemplification of the invention and it is not intended to limit the invention to the specific embodiments illustrated.

Figure 2:
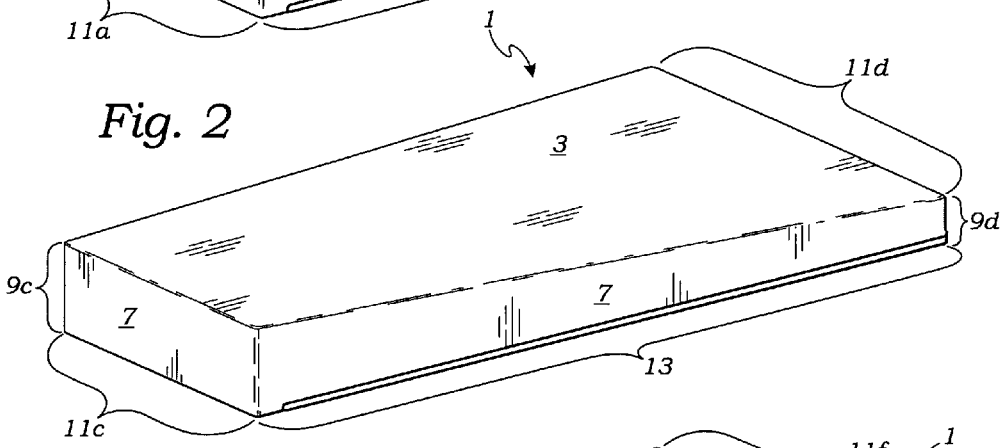
FIG. 2 is a perspective view illustrating a second embodiment of the forearm support of the present invention.
Figure 3:
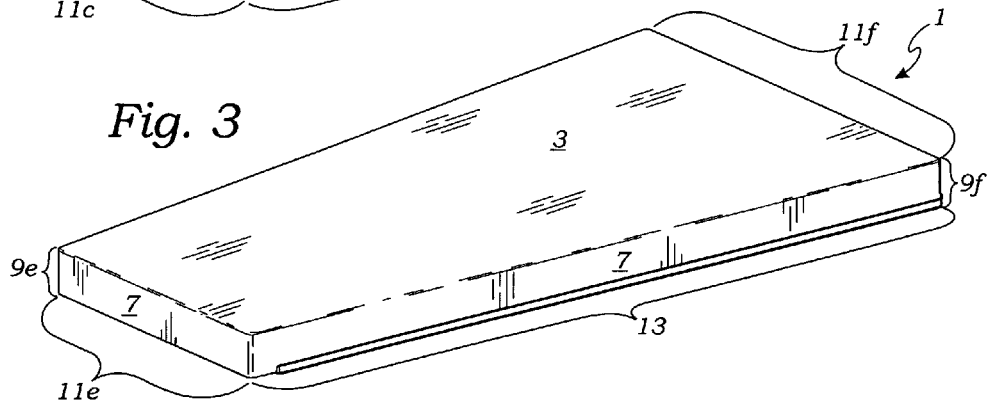
FIG. 3 is a perspective view illustrating a third embodiment of the forearm support of the present invention.

As shown in the Figures, the present invention is directed to a forearm support 1. The forearm support includes a top 3 and a bottom 5. In addition, the forearm support includes one or more sides. As shown in FIGS. 1-3, in a preferred embodiment, the forearm support includes four sides and preferably has a truncated trapezoidal footprint.

The forearm support may be any size which is suitable for manual maneuvering upon a desk surface and which is capable of supporting one's forearm above a work surface. Preferably, the forearm support has a thickness, also referred to as a height, of between one-half and four inches, a width of two to eight inches, and a length of four to sixteen inches. Even more preferably, the forearm support is one to three inches in height, three to five inches in width, and eight to twelve inches in length.

Figure 4:
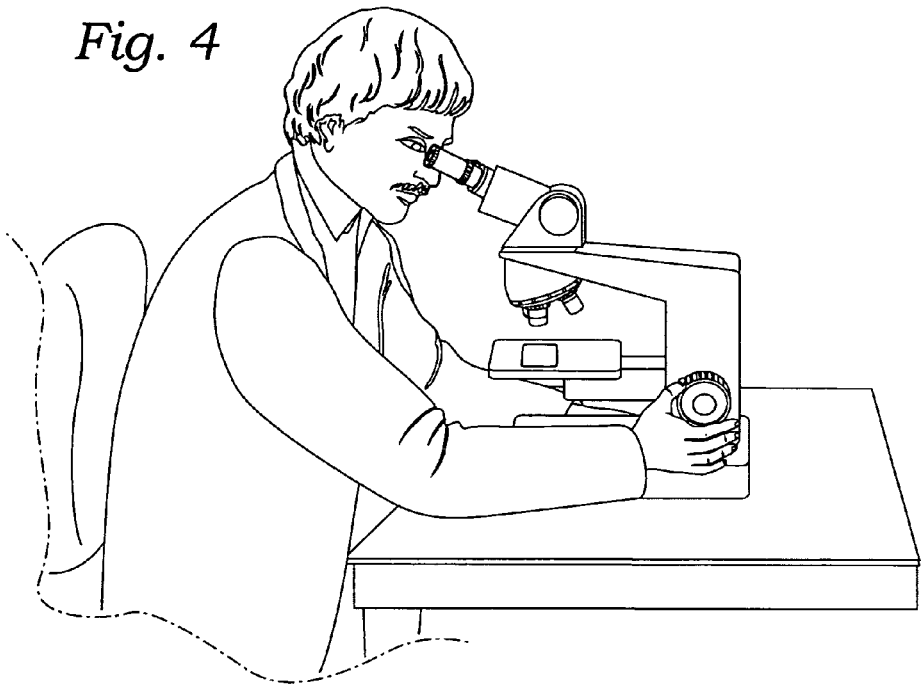
FIG. 4 illustrates an individual operating a microscope without use of a forearm support of the present invention.

As shown in FIG. 4, in a first preferred embodiment, the forearm support 1 includes four sides 7, a top 3, and a bottom 5. The forearm support has a length 13 of eight inches and a top surface providing a first height 9*a* of three inches sloping downwards to a height 9*b* of one inch. Meanwhile, the forearm support is also tapered from a width 11*b* of five inches to a width 11*a* of three inches.

In a second preferred embodiment shown in FIG. 2, the forearm support has a less dramatic slope in which it has a height 9*c* of two inches at the forearm support's narrow end and a height 9*d* of one inch at the forearm support's thicker end. In similar manner to the forearm support shown in FIG. 1, the forearm support shown in FIG. 2 has a width of three inches at its narrow extremity 11*c* and a width of five inches at the forearm support's opposite extremity 11*d*.

Figure 5:
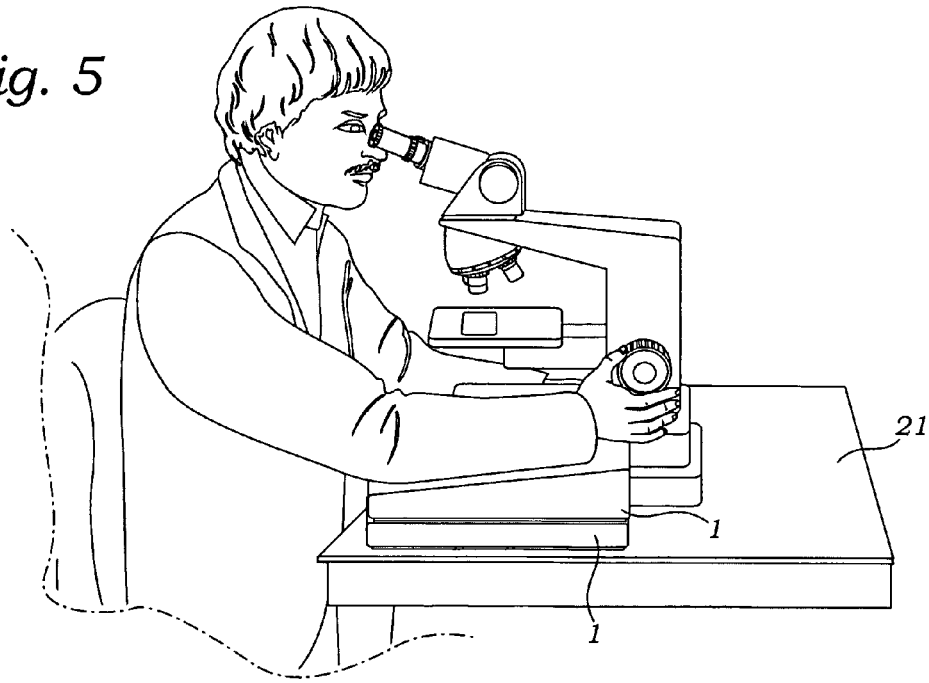
FIG. 5 is a perspective view illustrating an individual using a pair of stacked forearm supports of the present invention.
Figure 6:
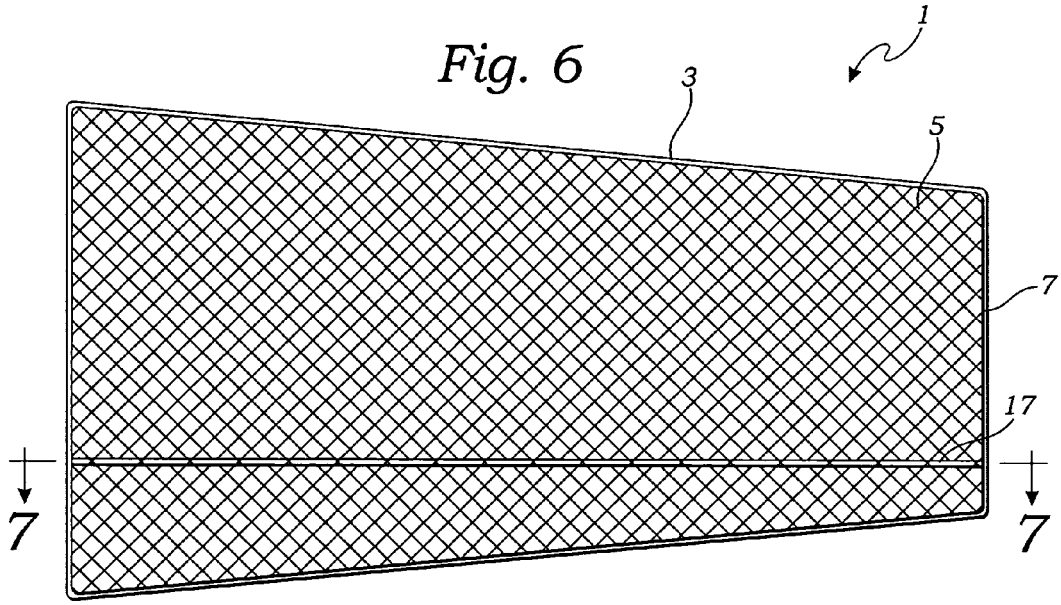
FIG. 6 is a bottom plan view of the forearm supports shown in FIG. 5.

In still a third embodiment of the present invention, as shown in FIG. 3, the forearm support 1 has a uniform height 9*d* of one inch. However, preferably, the forearm support has the same footprint, in other words lateral and longitudinal dimensions, as the forearm supports illustrated in FIGS. 1 and 2. Thus, the third embodiment of the forearm support has a length 13 of eight inches and a width 11*e* of three inches expanding to its opposite extremity 11*f* to a width of 5 inches. As shown in FIG. 5, by providing forearm supports having the same footprint, the forearm supports can be stacked uniformly to provide a forearm pad having the height and slope as desired by the user.

Advantageously, the forearm support of the present invention is constructed to dissipate charge so as to be used within electrostatic sensitive areas. To this end, the forearm support is covered on its top and sides with a static dissipative fabric. The preferred dissipative fabric is sold by Duracoat Corporation under the trademark DURA-STAT®, though other static dissipative materials can be selected by those skilled in the art after reading the present disclosure. The DURA-STAT® material includes inner and outer layers of vinyl with an interior layer of a conductive material. Conductive materials may include copper strands or carbon fibers. Though fabrics other that DURA-STAT® may be employed, it is preferred that fabric used for the sides and top of the forearm support comply with Military Standard MIL W-87893 entitled "Work station, electrostatic discharge (ESD) control, type III work surface, portable, flexible."

Figure 7:
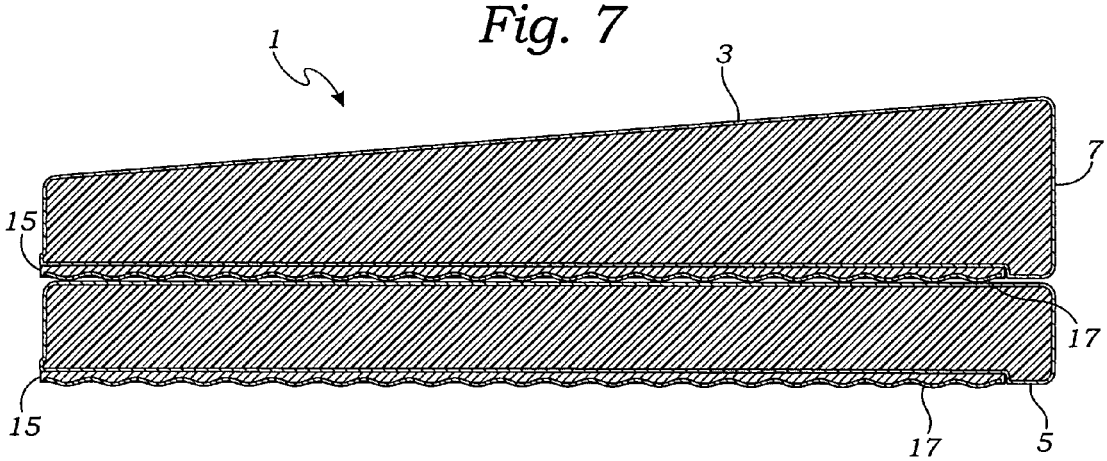
FIG. 7 is a cross-sectional side view of the stacked forearm supports shown in FIG. 6.

As shown in FIG. 7, the fabric of the top and sides preferably also covers the forearm support's bottom 5. In addition, preferably the forearm support include a non-slip surface 15 which has a higher coefficient of friction than the top or sides so as to inhibit movement of the forearm support when it is placed upon a work surface. Alternatively, or in addition to a conductive bottom surface, the forearm support 1 may include a strip of conductive ribbon 17 extending support's length. The ribbon is preferably made of a conductive material and electrically connected to the top and sides of the forearm support so that electrical charge can be dissipated from the top 3 and sides 7 through the conductive ribbon 17 to a work surface. In a preferred embodiment, the conductive ribbon is 9/16 inch wide, has a thickness of approximately 0.008 inch and has a fiber content of 89% polyester and 11% carbon nylon to provide a resistivity of 75,000 ohms per inch or less.

As shown in FIG. 5, a person working within an electrostatic sensitive area, such as a person operating a microscope to view ESD resistive components, can utilize one or more forearm support pads to support their forearm above a hard work surface. Preferably, the person within the electrostatic sensitive area is also wearing a static dissipative coat which allows charge to be transmitted through his clothing and through the forearm pad 1 to a work surface 21. Advantageously, the forearm support of the present invention complies with standard ANSI/ESD STMS20.20-1999 by providing a resistance value as measured from the top of the support to its bottom of less than $1\times10^9$ ohms.

Having described the invention in such terms to enable those skilled in the art to make and use it, and having identified the presently understood best mode of practicing the invention, I claim:

1. A forearm support comprising:

a top, a bottom and one or more sides forming an interior, said top, bottom and sides being flexible and said interior being made of a resiliently compressible material; and said top, bottom and sides made of a flexible and at least minimally electrically conductive materially so that said support has a resistance value from said top to said bottom of less than $1\times10^9$ ohms, wherein said support includes four sides and said top, bottom and sides defining a height, width and length, said support being between 0.5-4 inches in height, and 2-8 inches in width, and 4-16 inches in length.

2. The forearm support of claim 1 wherein said bottom includes a non-slip surface having a coefficient of static friction greater than said sides and top.

3. The forearm support of claim 2 wherein said bottom includes an electrically conductive strip having a resistivity of 75,000 ohms per inch or less.

4. The forearm support of claim 3 wherein said electrically conductive strip is made of plastic and carbon fibers.

5. A forearm support comprising:

a top, a bottom and one or more sides forming an interior, said top and sides including an outer layer of static dissipative plastic; said bottom layer including a non-slip surface having a coefficient of static friction greater than said sides and top and including an electrically conductive strip having a resistivity of 75,000 ohms per inch or less; and said interior being filled with a resiliently compressible foam material; and said top, bottom and sides made of a flexible and at least minimally electrically conductive materially so that said support has a resistance value from said top to said bottom of less than $1\times10^9$ ohms.

6. The forearm support of claim 5 wherein said support includes four sides and said top, bottom and sides defining a height, width and length, said support being between 0.5-4 inches in height, and 2-8 inches in width, and 4-16 inches in length.

7. The forearm support of claim 5 wherein said support includes four sides and said top, bottom and sides defining a height, width and length, said support being between 1-3 inches in height, and 3-5 inches in width, and 8-12 inches in length.

8. Method of protecting electrostatic sensitive components from static discharge during electrostatic sensitive operations:

providing a forearm support a top, a bottom and one or more sides forming an interior, said top, bottom and sides being flexible and said interior being made of a resiliently compressible material, and said top, bottom and sides made of a flexible and at least minimally electrically conductive materially so that said support has a resistance value from said top to said bottom of less than $1\times10^9$ ohms, wherein said support includes four sides and said top, bottom and sides defining a height, width and length;

providing an electrostatic sensitive object in proximity to said forearm support;

placing a person's forearm upon said support to form a conductive path from said forearm through said support to form a grounded forearm; and manually manipulating said electrostatic sensitive object using said grounded forearm.

9. The method of protecting electrostatic sensitive components of claim 8 wherein said support includes four sides and said top, bottom and sides defining a height, width and length, said support being between 1-3 inches in height, and 3-5 inches in width, and 8-12 inches in length.

10. The method of protecting electrostatic sensitive components of claim 8 wherein said bottom includes a non-slip surface having a coefficient of static friction greater than said sides and top.

11. The method of protecting electrostatic sensitive components of claim 10 wherein said bottom includes an electrically conductive strip having a resistivity of 75,000 ohms per inch or less.

12. The method of protecting electrostatic sensitive components of claim 11 wherein said electrically conductive strip is made of plastic and carbon fibers.

13. The method of protecting electrostatic sensitive components of claim 12 wherein said support includes four sides and said top, bottom and sides defining a height, width and length, said support being between 0.5-4 inches in height, and 2-8 inches in width, and 4-16 inches in length.

14. The method of protecting electrostatic sensitive components of claim 12 wherein said support includes four sides and said top, bottom and sides defining a height, width and length, said support being between 1-3 inches in height, and 3-5 inches in width, and 8-12 inches in length.

* * * * *